US006422680B1

(12) United States Patent
Hayakawa et al.

(10) Patent No.: US 6,422,680 B1
(45) Date of Patent: Jul. 23, 2002

(54) INK JET RECORDING APPARATUS AND CLEANING CONTROL METHOD FOR THE SAME

(75) Inventors: Hitoshi Hayakawa; Shigenori Fukasawa, both of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/594,710

(22) Filed: Jun. 16, 2000

(30) Foreign Application Priority Data

Jun. 17, 1999 (JP) ..... 11-171257
Sep. 27, 1999 (JP) ..... 11-273238

(51) Int. Cl.[7] ..... B41J 2/165
(52) U.S. Cl. ..... 347/30
(58) Field of Search ..... 347/22, 23, 29, 347/30, 33, 34, 36

(56) References Cited

U.S. PATENT DOCUMENTS 6,010,203 A * 1/2000 Muraki ..... 347/30

FOREIGN PATENT DOCUMENTS

EP 0 850 765 7/1998 ..... B41J/2/165
EP 0 850 765 A2 * 7/1998 ..... B41J/2/165
GB 2 311 041 A * 9/1997 ..... B41J/2/165

OTHER PUBLICATIONS

European Search Report.
Patent Abstracts of Japan 10024598 Jan. 27, 1998.

* cited by examiner

*Primary Examiner*—Huan Tran
(74) *Attorney, Agent, or Firm*—Sughrue Mion, PLLC

(57) ABSTRACT

An ink jet recording apparatus having a capping unit for sealing the nozzle formation face of a recording head and sucking and discharging ink from the recording head by the action of a negative pressure from a suction pump and a wiping member capable of wiping out the nozzle formation face and a cleaning control method of the recording apparatus are provided. In the recording apparatus, a well-known atmosphere valve placed in a capping unit of is eliminated, so that occurrence of a large amount of bubbles in the capping unit as the atmosphere valve is opened can be avoided. As the atmosphere valve is eliminated, a capping state is released with waste ink stored in the capping unit, but waste ink leaked from the capping unit is prevented from remaining in the vicinity of the outer peripheral surface of a cap member, and contaminating of recording paper, etc., by the remaining waste ink can be minimized.

22 Claims, 15 Drawing Sheets

INK JET RECORDING APPARATUS AND CLEANING CONTROL METHOD FOR THE SAME

BACKGROUND OF THE INVENTION

This invention relates to an ink jet recording apparatus being placed on a reciprocatively movable carriage for jetting ink drops toward recording paper in response to print data, thereby printing on the recording paper and a cleaning control method in the recording apparatus and in particular to a cleaning control technique for eliminating an atmosphere valve communicating with a capping unit for sealing a recording head and simplifying an ink discharge sequence from the recording head executed by the capping unit. It also relates to a recording apparatus for solving a problem of contaminating recording paper, etc., by waste ink stored in the capping unit that can be produced by eliminating the atmosphere valve.

An ink jet recording apparatus produces relatively small noise at the printing time and moreover can form small dots at a high density and therefore recently has been used for various types of printing including color printing.

Such an ink jet recording apparatus comprises an ink jet recording head which receives supply of ink from an ink cartridge and is reciprocated in a main scanning direction and a paper feeder for carrying recording paper in a sub-scanning direction orthogonal to the recording head and jets ink drops from the recording head based on print data, thereby recording on the recording paper.

A recording head capable of jetting black, yellow, cyan, and magenta inks, for example, is placed on a carriage and the color ink jetting percentage can be changed for executing full color printing as well as text printing in black ink.

The described ink jet recording head involves a problem of clogging nozzle orifices and causing a print failure because of a rise in ink viscosity caused by evaporation of a solvent from the nozzle orifices, solidification of ink deposition of dust, mixing of air bubbles as ink pressurized in a pressure generating chamber is jetted to recording paper as ink drops from the nozzle orifices for printing. Thus, this kind of ink jet recording apparatus comprises a capping unit for sealing the nozzle formation face of the recording head at the non-printing time.

The capping unit functions as a lid for preventing ink in the nozzle orifices of the recording head from being dried. In addition, if the nozzle orifices are clogged, the capping unit also provides an ink jet capability recovery function of sealing the nozzle formation face by the capping unit and sucking and discharging ink from the nozzle orifice by a negative pressure from a suction pump for unclogging the nozzle orifices.

The forcible ink suction and discharge treatment executed for unclogging the recording head is called cleaning operation; to restart printing after a halt for a long time or when the user recognizes a print failure and, for example, operates a cleaning switch, the cleaning operation is executed. A negative pressure produced by the suction pump is added and ink is sucked from the recording head and discharged into the capping unit, then the nozzle formation face is wiped out by a wiping member formed of a rubber material, etc., for example.

The capping unit is placed, for example, at an end of the recording apparatus out of a print area (home position) and is mounted on an elevating mechanism that can be lifted up to the nozzle formation face side of the recording head by a driving force of the carriage accompanying a move of the carriage to the home position side.

A recovery function of applying a drive signal not related to printing to the recording head for idly jetting ink drops, called flushing operation, is also provided. It is executed every given period for recovering an irregular meniscus if the irregular meniscus occurs in the proximity of the nozzle orifice of the recording head and preventing clogging as viscosity of ink is increased in the nozzle orifice less jetting ink drops during printing.

FIG. 12 is a top view of the configuration of a capping unit 71 in related art used for the described cleaning operation. The capping unit 71 is placed at an end (home position) out of the placement position of a paper guide plate 72 forming a print area.

A recording head mounted on a carriage (not shown in FIG. 12 and described later) is guided by a guide rod so that it can move just above the paper guide plate 72 and the capping unit 71.

The capping unit 71 comprises a cap member 73 formed of a flexible rubber material, etc., that can seal the nozzle formation face of the recording head positioned just above the capping unit 71 and has a function of sealing the nozzle formation face of the recording head at the non-printing time for preventing ink in the nozzle orifices firm being dried and a function of receiving a negative pressure from a suction pump (described later) and forcibly discharging ink from the recording head at the cleaning operation time.

Thus, a cap holder 74 on which the cap member 73 is mounted is placed on an elevating mechanism that can be lifted up to the nozzle formation face side of the recording head by a driving force of the carriage accompanying a move of the carriage to the home position side.

An ink absorbing sheet 75 is housed in the cap member 73 and the cap member 73 is formed at an inner bottom part with an ink suction port 76. One end of a tube forming a part of a tube pump (not shown) is connected to the ink suction port 76.

The cap member 73 is formed at an inner bottom part with an atmosphere port 77. A tube 78 is connected at one end to the atmosphere port 77 and connected at an opposite end to a valve 79. The valve 79 is opened and closed by a valve body 80 and the valve body 80 is placed in a state normally closing the valve 79 by a spring 81. The valve body 80 is molded integrally with a valve rod 82 and the valve rod 82 is held so that it can be slid axially for opening and closing the valve.

An end of the valve rod 82 abuts a stopper 84 formed on a frame 83, whereby the valve 79 is opened against the repulsion force of the spring 81.

A cleaner holder 87 comprising a wiping member 86 made of a rubber material, for example, that can wipe out the nozzle formation face of the recording head mounted on the carriage accompanying a move of the carriage is placed on the print area side adjacent to the capping unit so that it can be advanced to or retreated from the move path of the recording head.

FIG. 13 shows the cleaning sequence of the recording head in the related art, executed by the described capping unit 71. The cleaning operation in the recording apparatus in the related art will be discussed according to a flowchart shown in FIG. 13.

First, when cleaning treatment is started, operation unnecessary for the cleaning treatment, such as paper feed operation, is all inhibited at step S11. In this state, the cleaner holder 87 is moved in the horizontal direction and the wiping member 86 is advanced onto the move path of the recording head.

As the carriage is moved, the wiping operation of wiping out the nozzle formation face of the recording head by the wiping member 86 is executed at step S12, whereby dust, paper powder, and the like adhering to the nozzle formation face are removed.

Subsequently, the carriage is moved to the capping position and large suction operation of ink from the recording head is executed at step S13. FIGS. 14A to 14D schematically show the large suction operation executed at step S13 and later. In FIG. 14, numeral 91 denotes the recording head, numeral 73 denotes the cap member, and numeral 79 denotes the valve connected to the atmosphere port 77 made in the inner bottom part of the cap member by the tube 78.

Further, numeral 92 denotes the suction pump; waste ink can be discharged into a waste tank 93 through the tube pump 92 connected to the ink suction port 76 made in the inner bottom part of the cap member.

First, FIG. 14A shows a state in which the recording head 91 is sealed by the cap member 73. Subsequently, as shown in FIG. 14B, the atmosphere valve 79 connected to the cap member 73 is closed and in this state, the suction pump 92 is driven for a predetermined time for accumulating a negative pressure in the cap member 73. In this state, ink is sucked and discharged into the cap member 73 by the accumulated negative pressure at step S14 in FIG. 13.

Thus, ink is discharged from the recording head 91 as shown in FIG. 14C and an amount of ink matching the negative pressure is discharged into the inner space of the cap member 73 as shown in FIG. 14D.

Thus, when the pressure in the cap member 73 rises to such an extent that it is brought close to the atmospheric pressure, control goes to step S15 shown in FIG. 13 and the atmosphere valve 79 is opened and the suction pump 92 is driven.

FIGS. 15A and 15B show this state. That is, if the atmosphere valve 79 is opened as shown in FIG. 15A, some air flows into the cap member 73 through the valve 79 by the action of the negative pressure remaining in the cap member 73, as shown in FIG. 15B, and the inside of the cap member 73 becomes the atmospheric pressure.

As the suction pump 92 is driven, the ink discharged into the cap member 73 is discharged into the waste tank 93. In this case, while the suction pump 92 is rotated at low speed and bubbles produced by inflow of air from the valve 79 are suppressed, ink in the cap member 73 is discharged.

After the steps are executed, the wiping operation at step S16 in FIG. 13 is executed. In this case, the cleaner holder 87 is moved in the horizontal direction and the wiping member 86 is advanced to the move path of the recording head.

As the carriage is moved, the nozzle formation face of the recording head 91 is wiped out by the wiping member 86 and ink adhering to the nozzle formation face of the recording head 91 is scraped away by the wiping member 86.

At step 817 following the wiping operation, the suction pump 92 is driven with the cap member 73 released from the recording head 91. FIG. 15C shows this state; the ink remaining in the cap member 73 is discharged into the waste tank 93.

At steps S13 and S14 described above, when the large suction operation is executed and ink is sucked and discharged from the recording head, a large amount of ink remains in the cap member 73 and thus if the atmosphere valve 79 is opened, the ink in the cap member 73 is sucked to the suction pump 92 and is discharged into the waste tank 93 while producing bubbles, as shown in FIG. 15B. Therefore, the bubbles enter the nozzle orifices of the recording head 91 and destroy meniscuses formed in the nozzle orifices; this is a problem.

Then, in the cleaning sequence in the related art, to restore the destroyed meniscuses to their former shapes, a sequence at step S18 and later steps in FIG. 13 is executed subsequently.

That is, at step S18, the first small suction operation is executed for the recording head 91. Also in this case, the recording head is sealed by the cap member and the suction pump is driven for a shorter time than that at the large suction time for giving a weak negative pressure to the inside of the cap member for discharging ink although not shown.

Subsequently, step S19 is executed like step S14; at step S19, the bubble degree can be lessened because the amount of ink remaining in the cap member is small.

At steps S21 and S22, the wiping operation is executed and the suction pump is driven in almost similar manners to those at steps S16 and S17. Steps S18 to S22 are repeated as many times as required, whereby the meniscuses of the nozzle orifices destroyed by the bubbles are restored.

It is determined at step S23 that steps S18 to S22 have been repeated a predetermined number of times, control goes to step S24 at which the finish wiping operation is executed, whereby the meniscuses are recovered to an almost complete state. At step S25, the recording head is moved to a position not opposed to the cap member and the suction pump 92 is driven for discharging the ink in the cap member.

Next, fine vibration is given to the recording head, for example, by forward and reversely turning a carnage motor at step S26, promoting dissolving of the bubbles taken into the nozzle orifices by the cleaning operation, etc., in ink.

After the fine vibration is given, a flushing hold flag is turned on at step S27 and a flushing hold timer (not shown) is started at step 828.

Thus, the flushing operation is inhibited for a predetermined time of time-out of the flushing hold timer or more and the bubbles produced by the cleaning operation are dissolved in the ink for preventing a print failure from occurring.

The recording head is moved to the capping position and the nozzle formation face of the recording head is sealed by the cap member at step S29 and any inhibited operation other than the cleaning treatment is enabled at step S30.

When the flushing hold timer counts the predetermined time, for example, after the expiration of the time required for the bubbles in the vicinity of the nozzle orifices to be dissolved in ink and disappear, flushing is executed for cleaning at step S32 and the flushing hold flag is turned on at step S33, then a standby mode is entered.

The ink jet recording apparatus having the cleaning function as described above comprises the atmosphere valve 79 communicating with the cap member forming the capping unit and adopts a sequence of executing the ink suction operation by a negative pressure and then opening the valve for discharging ink.

Thus, it is necessary to place the atmosphere valve 79 adjacent to the cap member 73 as shown in FIG. 12. As previously described with reference to FIG. 12, the valve body 80 molded integrally with the slidable valve rod 82 is urged in a dosed state by the spring 81 and the end part of the valve rod 82 abuts the stopper 84 formed on the frame 83, whereby the atmosphere valve 79 is opened against the repulsion force of the spring 81.

Therefore, a large number of steps are required for managing and assembling the assembly parts making up the atmosphere valve and moreover the percent defective is relatively high; this is a problem. Further, in the connection tube from the cap member the atmosphere valve, the water content evaporation degree is large and it is difficult to sufficiently retain the moisture in the cap member at the non-printing time; this is also a problem.

Further, as described above, to discharge ink from the cap member after the large suction operation is executed and ink is sucked and discharged from the recording head, a large amount of ink remains in the cap member, thus a phenomenon in which the ink in the cap member 73 is sucked to the suction pump 92 and is discharged to the waste tank 93 while producing bubbles occurs as shown in FIG. 15B.

Thus, the problem of the bubbles entering the nozzle orifices of the recording head and destroying the meniscuses formed in the nozzle orifices is involved. Therefore, in the cleaning sequence in the related art, to restore the destroyed meniscuses to their former shapes, it is necessary to repeat the loop of steps S18 to S22 shown in FIG. 13 more than once and further execute the appurtenant sequence consisting of steps S24 to S28.

Therefore, the time required for the cleaning operation also becomes large, resulting in bothering the user, for example, irritating the user On the other hand, control as described above is executed, whereby the evil effect produced as bubbles occur can be avoided, but when the atmosphere valve is eliminated according to the above context, a situation occurs wherein the capping unit is brought away from the nozzle formation face with waste ink stored in the cap member to perform the cleaning operation. In such a situation, the effect of vibration, etc., is received and ink is leaked from the inside of the capping unit to the outside and particularly adheres to the outer peripheral surface of the cap member forming the sealing part of the capping unit and remains thereon; this is a problem.

The remaining ink is deposited on the recording head, developing a problem of the ink dripping down on recording paper placed on the print area during printing and contaminating the recording paper at times.

On the other hand, if the nozzle formation face is wiped out by the wiping member after ink is sucked and discharged from the recording head, there is also a problem of scattering the ink scraped away from the nozzle formation face to the capping unit side by the reaction of mechanical return of the wiping member, thus a problem of waste ink deposited and remaining on the outer peripheral surface of the cap member is also involved.

With the recording apparatus comprising a capping unit into which a cap member forming a seating part of the capping unit and a cap holder for holding the cap member are assembled, ink enters the gap formed between the cap member and the cap holder and the discharging effect of ink in the gravity direction can be provided to some extent, thus the problem of ink dripping down on recording paper from the recording head during printing, etc., and contaminating the recording paper as described above is relatively hard to occur.

However, with the recording apparatus comprising integral-type a capping unit with no gap between a cap member and a cap holder, escape of ink in the gravity direction is prevented, so that the problem of ink remaining on the outer peripheral surface of the cap member occurs and the problem of contaminating recording paper by the action described above occurs remarkably.

SUMMARY OF THE INVENTION

It is therefore a first object of the invention to provide an ink jet recording apparatus for simplifying an ink discharging sequence from a recording head, executed by a capping unit with the above-described atmosphere valve eliminated, and a cleaning control method in the recording apparatus.

And it is a second object of the invention to provide an ink jet recording apparatus adapted to aggressively escape ink to remain on the outer peripheral surface of a cap member in the gravity direction for decreasing the amount of ink deposited on a recording head to prevent recording paper, etc., from being contaminated even if the atmosphere valve is eliminated.

In order to achieve the first object, according to the invention, there is provided an ink jet recording apparatus comprising:

- a recording head having a face on which nozzle orifices from which ink drops are ejected in accordance with print data are formed;
- a carriage for mounting the recording head;
- a capping unit having a sealing face for sealing the nozzle formation face of the recording head, and having an inner space connected to a suction pump;
- a wiping member for wiping the nozzle formation face; and
- a controller for controlling the capping unit so as to (i) seal the nozzle formation face with the sealing face, (ii) drive the suction pump to apply negative pressure into the inner space to discharge ink from the nozzle orifices, and (iii) keep the sealing state until a first predetermined time period required for restoring the negative pressure to the atmospheric pressure elapses after the ink has been discharged.

In this case, when the capping unit seals the nozzle formation face of the recording head and sucks and discharges ink from the nozzle orifices by the action of the negative pressure from a suction pump, it is desired that the wiping member is advanced onto the move path of the recording head.

Preferably, the wiping member moves from an initial position to a second position where is on a moving path of the recording head when the capping unit executes the ink discharge operation.

Preferably, the controller separates the capping unit from the nozzle formation face such that the sealing face is inclined with respect to the nozzle formation face after the first predetermined time period has elapsed.

Preferably, the ink jet recording apparatus further comprises a waste ink tank connected to the capping unit via the suction pump. The controller drives the suction pump to discharge ink stored in the inner space into the waste ink tank when the capping unit is separated from the nozzle formation face.

Preferably, the controller controls the wiping member so as to wipe the nozzle formation face after the capping unit has been separated from the nozzle formation face.

Preferably, the ink jet recording apparatus further comprises a carriage motor for driving the carriage reciprocatively between a print region and a home position. The capping unit is moved toward the recording head to seal the nozzle formation face by using driving force of the carriage motor for moving the carriage toward the home position. The capping unit is separated from the nozzle formation face by using driving force of the carriage motor for moving the carriage toward the print region. The carriage motor has a first speed established when the capping unit is separated from the recording head and a second speed, which is faster than the first speed, established when the carriage passes through the second position of the wiping member.

Preferably, the controller drives the suction pump again after the nozzle formation face has been wiped out by the wiping member in order to discharge ink stored in the inner space of the capping unit.

In order to achieve the first object, according to the invention there is also provided a cleaning control method for an ink jet recording apparatus which comprises: a recording head having a face on which nozzle orifices from which ink drops are ejected in accordance with print data are formed; a carriage for mounting the recording head; a capping unit having a sealing face for sealing the nozzle formation face of the recording head, and having an inner space connected to a suction pump; and a wiping member for wiping the nozzle formation face, the method comprising the steps of:

sealing the nozzle formation face with the capping unit;

driving the suction pump to apply negative pressure into the inner space to discharge ink from the nozzle orifices; and waiting until a first predetermined time period required for restoring the negative pressure to the atmospheric pressure elapses while keeping a state that the nozzle formation face is sealed with the capping unit.

Preferably, the cleaning control method further comprises the steps of:

separating the capping unit from the nozzle formation face after the first predetermined time period has elapsed; and driving the suction pump to discharge ink stored in the inner space of the capping unit into an ink waste tank synchronously with the separating step.

Preferably, the cleaning control method further comprises the step of wiping the nozzle formation face with the wiping member executed after the separating step has been executed.

Alternatively, the cleaning control method further comprises the steps of:

separating the capping unit from the nozzle formation face after the first predetermined time period has elapsed; and wiping the nozzle formation face with the wiping member.

Preferably, the cleaning control method as set forth in claim 19, further comprising the step of driving the suction pump again to discharge ink stored in the inner space of the capping unit after the wiping step has been executed.

According to the above ink jet recording apparatus and the above cleaning control method in the recording apparatus, the atmosphere valve is eliminated and after the step of sucking and discharging ink from the recording head, the step of holding the seating state of the nozzle formation face of the recording head by the capping unit and waiting until the expiration of a predetermined time required for the inner space of the capping unit to be restored to the atmospheric pressure is eliminated. Thus, a necessary and sufficient amount of ink increased in viscosity can be discharged.

The recording head sealed by the capping unit is unsealed and the suction pump is driven, whereby the ink in the capping unit is discharged into the waste tank.

Therefore, the factor of producing bubbles in ink in the capping unit as shown in the cleaning sequence in the related art is eliminated, so that the evil effect produced by bubbles of ink as the atmosphere valve is opened as in the recording apparatus comprising the atmosphere valve in the related art can be removed.

Therefore, the small suction operation of ink, etc., for restoring meniscuses to their former shapes need not be executed and it is made possible to simplify the cleaning sequence.

In order to achieve the second object, preferably, the capping unit includes a cap member made of a flexible material, which is to be abutted against and seal the nozzle formation face, and a cap holder made of a hard material and having a circumferential wall for holding the cap member therein. The cap member has a portion protruded from an upper end face of the circumferential wall. A dimension between a top end of the protruded portion and the upper end face of the circumferential wall is larger than a dimension between a lower end of the protruded portion and an outer edge of the circumferential wall.

Preferably, the protruded portion of the cap member has a cross section shaped into a substantially triangle.

In this case, ink to remain on the outer peripheral surface of the cap member can be effectively escaped in the gravity direction. Thus, the amount of ink to remain on the outer peripheral surface of the cap member can always be decreased and it is made possible to minimize the problem of allowing the ink remaining on the outer peripheral surface of the cap member to adhere to the recording head and contaminate recording paper.

Preferably, the capping unit includes a spring for urging the cap member toward the nozzle formation face. The cap holder includes a spring holder formed on a outer face of the circumferential wall of the cap holder for holding one end of the spring. The spring holder has at least one opening for leading ink remaining on an outer circumferential face of the cap member toward a gravity direction.

Preferably, an upper face of the spring holder and the upper end face of the circumferential define a substantially identical plane.

In this case, the amount of ink to remain on the upper face of the spring holder can be decreased effectively.

Preferably, a plurality of openings are adjacently arranged along the outer face of the circumferential wall of the cap holder.

In this case, ink to remain on the upper face of the flat spring holder can be discharged through any of the openings in the gravity direction, contributing to the ink amount reducing effect on the upper face of the spring holder where ink easily remains.

Preferably, the opening is shaped into a polygon forming comers therein.

In this case, the guiding and excluding action of ink can be promoted by capillary action at the comers of the inner faces of the opening.

Preferably, the cap member and the cap holder are integrally formed by either an insert molding or a two-color molding.

Preferably, the flexible material is either an elastomer or rubber.

DETAILED DESCRIPTION OF THE PREFERRED EMBODIMENTS

Figure 1:
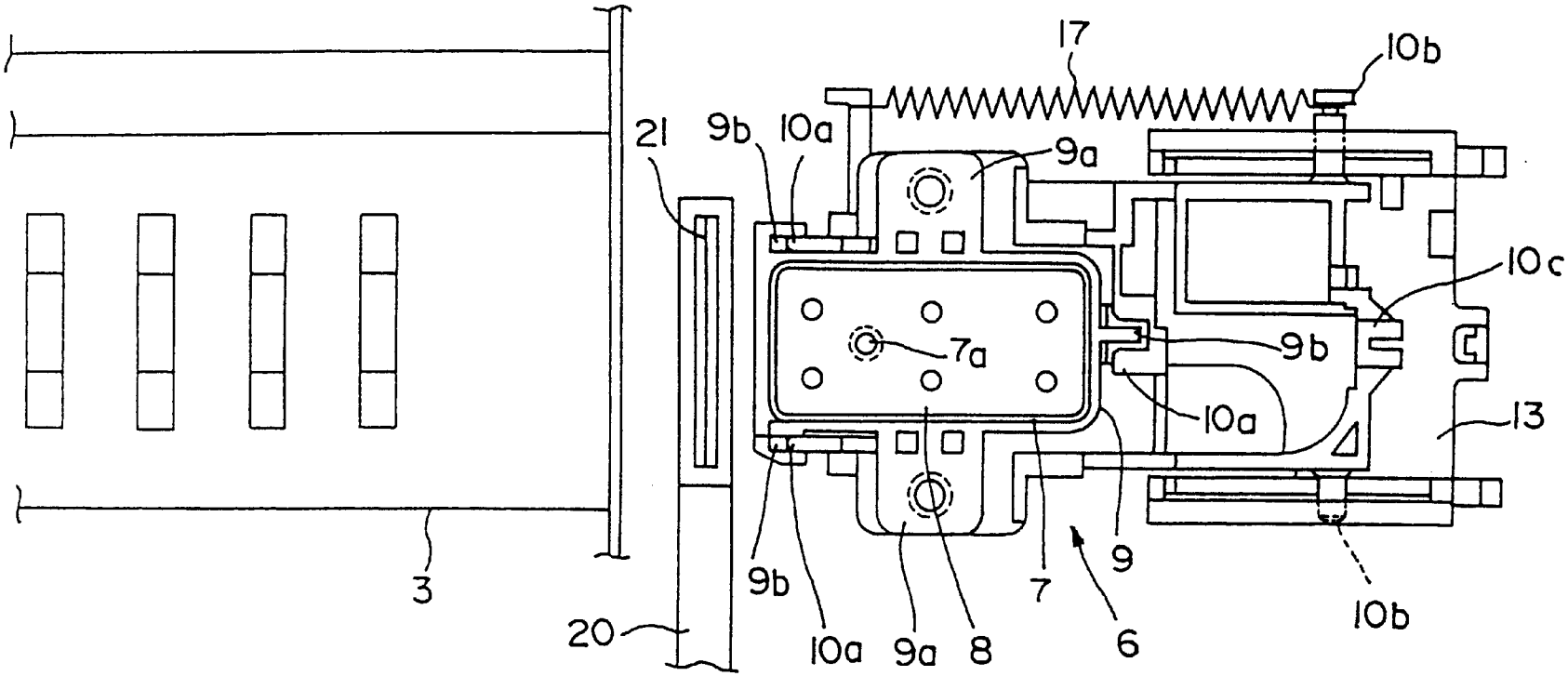
FIG. 1 is a plan view to mainly show the configuration of a capping unit in an ink jet recording apparatus according to a first embodiment of the invention.
Figure 2:
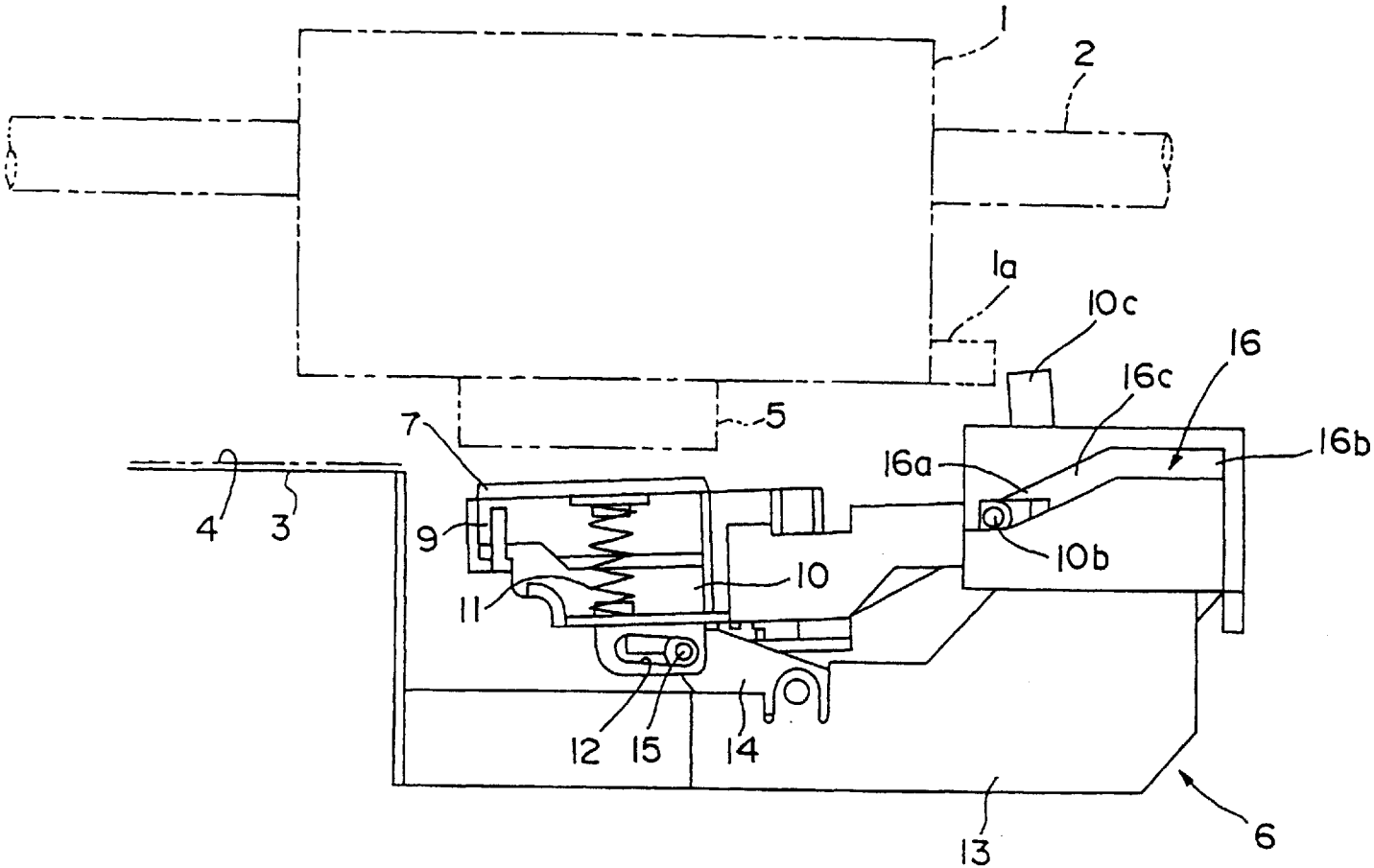
FIG. 2 is a side view to show the configuration of the capping unit shown in FIG. 1.
Figure 3:
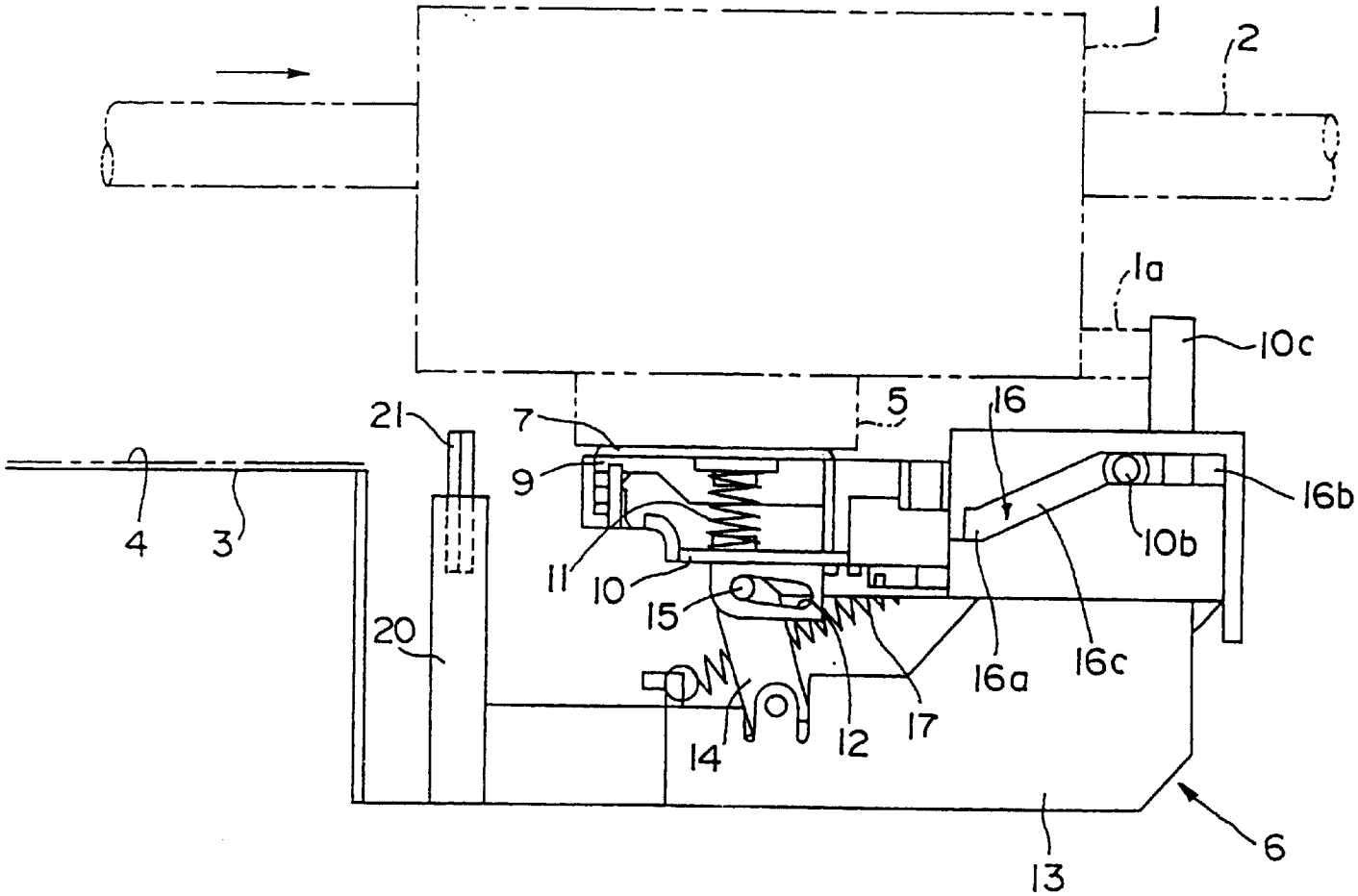
FIG. 3 is a side view to show a state in which a recording head is capped by the capping unit shown in FIG. 1.

Referring now to the accompanying drawings, there are shown preferred embodiments of ink jet recording apparatus according to the invention. FIGS. 1 to 3 show mainly the configuration of a capping unit in an ink jet recording apparatus according to a first embodiment of the invention. FIG. 1 is a top view of the recording apparatus and FIGS. 2 and 3 are side views of the recording apparatus; FIG. 2 shows a non-capping state and FIG. 3 shows a capping state.

In FIGS. 2 and 3 numeral 1 denotes a carriage. The carriage 1 is guided by a guide rod 2 and is moved in parallel facing a paper guide plate 3.

The carriage 1 is joined to a part of a timing belt reciprocated by a carriage motor (not shown) and is reciprocated along the guide rod 2.

A recording head 5 is mounted on the carriage 1 so as to face recording paper 4 placed on the top of the paper guide plate 3, ink is introduced into the recording head 5, and ink drops can be jetted to the recording paper 4 on the paper guide plate 3 in response to print data for printing.

A capping unit 6 for sealing the recording head 5 is placed in a nonprint area at an end of the recording apparatus (home position) and comprises a cap member 7 of a size capable of sealing the nozzle formation face of the recording head 5 with a seal space. It comprises a function of sealing the nozzle formation face of the recording head 5 at the non-printing time for preventing ink in the nozzle orifices from being dried and a function of receiving a negative pressure from a suction pump (not shown) and forcibly discharging ink from the recording head 5 at the cleaning operation time.

The cap member 7 placed on the capping unit 6 is formed at an inner bottom part with an ink discharge port 7*a* as shown in FIG. 1 and a tube pump as the suction pump (described later) is connected at one end to the ink discharge port 7*a*.

Thus, the nozzle formation face of the recording head 5 is sealed by the cap member 7 at the non-printing time, and upon reception of a cleaning command, a negative pressure produced by the suction pump can be applied to the inner space of the capping unit 6 for forcibly discharging ink from the recording head 5. An ink absorption sheet 8 is housed in the cap member 7 so as to hold absorbed ink.

The cap member 7 is molded integrally with a rectangular cap holder 9 as described in detail and a flat spring holder 9*a* is formed in a horizontal direction on both side walls of the cap holder 9 in the length direction thereof.

The cap holder 9 is mounted on a slider 10 implemented as an elevating mechanism and is attached in a state in which it is urged to the recording head 5 side by a pair of compression springs 11 placed between the slider 10 and the spring holders 9*a*.

A retainer 9*b* is formed at the center of one end of the cap holder 9 and at both sides of an opposite end; the three retainers 9*b* are retained at three points by mating retainers 10*a* formed on the slider 10 corresponding to the engagement parts, whereby the cap holder 9 is regulated in an upward move, namely, a move to the recording head 5 side and is mounted on the slider 10.

The slider 10 is formed at lower bottom parts with a pair of long holes 12 almost in the horizontal direction and a pair of horizontal shafts 15 placed on the free end side of an arm 14 attached to a frame 13 for rotation is housed in the long holes 12 so that the horizontal shafts 16 can be moved, whereby the slider 10 can rise on an arc path with respect to the frame 13 through the arm 14.

A guide piece 10*b* is formed on both sides of an end of the slider 10 on the non-print area side and this pair of guide pieces 10 is supported by a pair of guide grooves 16 formed in the frame 13.

The guide groove 16 is made up of a lower part 16*a* formed at one end, a horizontal upper part 16*b* formed at an opposite end, and a slant part 16*c* connecting the parts 16*a* and 16*b*; these three areas are formed contiguously.

Further, as shown in FIG. 1, a tension spring 17 fixed at an one end to the frame 13 is fixed at an opposite end to one guide piece 10*b* and the slider 10 is urged so that it is placed in the print area direction and in the direction away from the recording head 5, namely, in the embodiment, placed downward by the action of the tension spring 17.

As shown in FIG. 2, when the carriage 1 moves just above the capping unit 6, an urging body 1*a* formed on the carriage 1 abuts against an urged piece 10*c* formed upright on the slider 10, whereby as shown in FIG. 3, the slider 10 rises through the arm 14 against the tension of the spring 17, whereby the cap member 7 molded integrally with the cap holder 9 can seal the nozzle formation face of the recording head 5 placed on the carriage 1.

When the carriage 1 moves to the print area side, abutment of the urging body 1*a* on the carriage 1 side against the urged piece 10*c* placed on the slider 10 is released and the slider 10 is placed in the state shown in FIG. 2 by the tension of the spring 17, whereby the nozzle formation face of the recording head 5 sealed by the cap member 7 is unsealed.

As shown in FIG. 2, the sealing face of the cap member 7, namely, the top end face abutting the nozzle formation face of the recording head 5 is placed in a inclined state with the nozzle formation face of the recording head 5.

That is, the sealing face of the cap member 7 is inclined to the home position side (in FIG. 2, right) end part so as to slightly move down to the print area side (in FIG. 2, left) because of the relation between the positions of the horizontal shafts 15 in the long holes 12 made in the slider 10 and the placement positions of the guide pieces 10*b* sliding in the guide grooves 16 formed in the frame 13.

To seal the nozzle formation face of the recording head 5, the cap member 7 first abuts the nozzle formation face from the home position side and as the slider 10 is moved up and the compression spring 11 is compressed, the cap member 7 seals the full nozzle formation face of the recording head 5.

To unseal the nozzle formation face of the recording head 5, the cap member 7 first comes off the end part of the print area side and is brought away from the nozzle formation face of the recording head 5 in a inclined state with the nozzle formation face.

On the other hand, as shown in FIG. 1 or 3, a cleaner holder 20 comprising a wiping member 21 made of, for example, rubber for wiping the nozzle formation face of the recording head 5 mounted on the carriage 1 with a move of the carriage 1 is placed on the print area side adjacent to the capping unit 6.

The cleaner holder 20 is moved in the horizontal direction and enables the wiping member 21 to be advanced to or retreated from a wiping position on the move path of the recording head 5.

Therefore, at the cleaning operation time, the wiping member 21 removes dust, paper powder, etc., adhering to the nozzle formation face of the recording head 5 before ink is absorbed and wipes out ink adhering to the nozzle formation face after ink is sucked.

In this case, in the embodiment, a move of the cleaner holder 20 holding the wiping member 21 and the pump for sucking the inner space of the capping unit to a negative pressure use the driving force of a paper feed motor (not shown) for carrying recording paper 4 on the paper guide plate 3. The wiping member 21 is advanced onto the move path of the recording head 5 with driving of the suction pump.

In the described configuration, when the carriage 1 is moved to the non-print area side by driving of the carriage motor, the urging body 1*a* placed on the carriage 1 abuts the urged piece 10*c* formed on the slider 10; as shown in FIG. 2.

As the carriage 1 is further moved to the home position side, the slider 10 rises through the arm 14 against the tension of the spring 17, as shown in FIG. 3.

On the other hand, the guide piece 10*b* formed on the slider 10 is moved from the lower part 16*a* to the slant part 16*c* to the upper part 16*b* making up the guide groove 16, whereby the cap member 7 molded integrally with the cap holder 9 seals the recording head 5 placed on the carriage 1.

Upon completion of thus sealing the nozzle formation face by the cap member 7, the cap member 7 is placed out of communicating with the atmosphere, enters a hermetic state, and suppresses evaporation of ink from the nozzle orifices for preventing the recording head 5 from being clogged.

When the carriage 1 is moved to the print area side by driving of the carriage motor, the urging body 1*a* placed on the carriage 1 comes off the urged piece 10*c* formed on the slider 10.

Therefore, the slider 10 is moved down by the tension of the spring 10 through the arm and as the guide piece 10*b* formed on the slider 10 is moved to the lower part 16*a* side. Thus, the recording head 5 sealed by the cap member 7 is unsealed.

Figure 4:
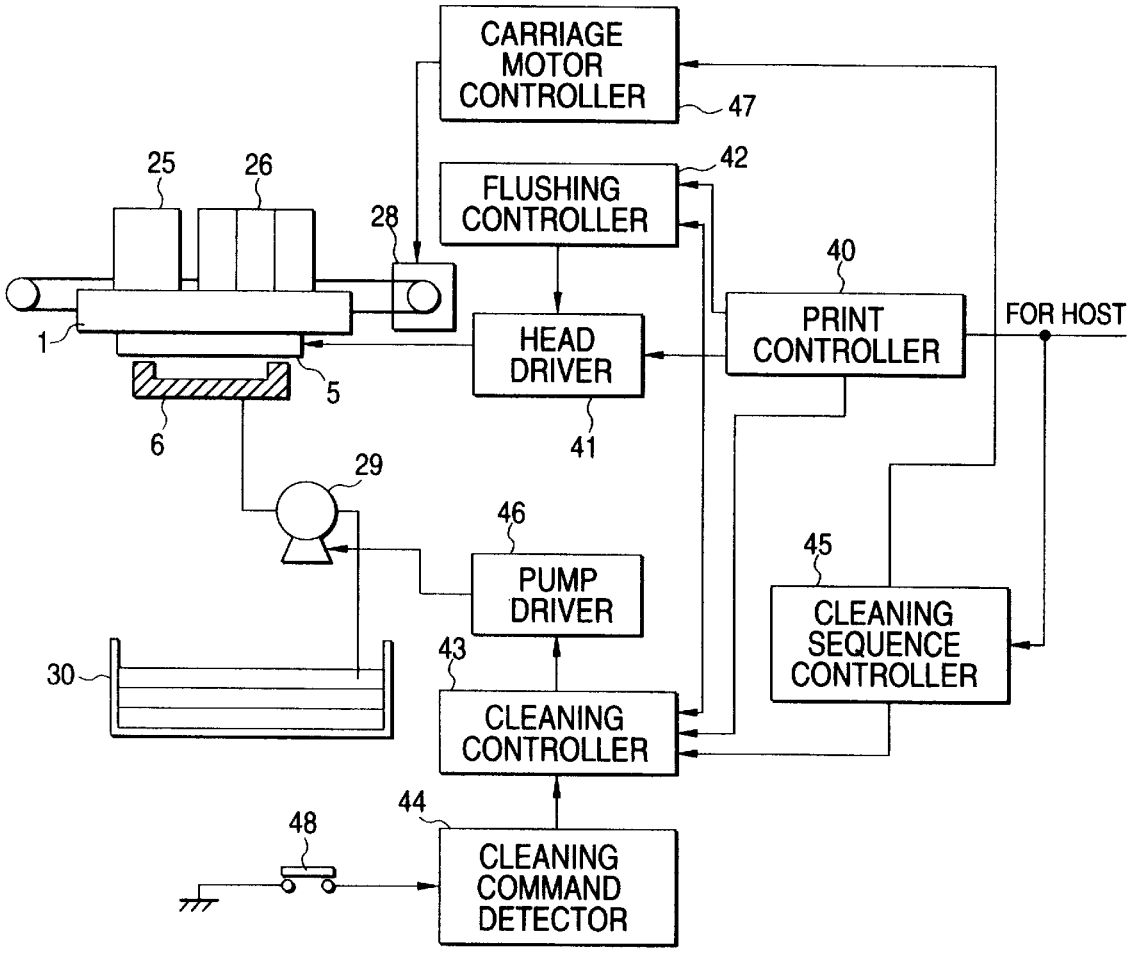
FIG. 4 is a block diagram to show an example of a control circuit installed in the recording apparatus shown in FIG. 1.

FIG. 4 shows the configuration of a control circuit installed in the described ink jet recording apparatus according to the invention. Parts identical with or similar to those previously described with reference to FIGS. 1 to 3 are denoted by the same reference numerals in FIG. 4 and therefore will not be discussed again.

As shown in FIG. 4, a black cartridge 25 and a color cartridge 26 are detachably attached to the carriage 1 and ink is supplied from the cartridges 25 and 26 to the recording head 5.

By driving of the carriage motor 28, the carriage 1 is guided by the guide rod 2 and is reciprocated. The suction pump 29 is connected to the capping unit 6 and the discharge side of the suction pump 29 is connected to a waste tank 30.

In FIG. 4, numeral 40 denotes a print controller. The print controller 40 has a function of preparing bit map data based on print data from a host computer and causing a head driver 41 to generate a drive signal based on the prepared data for jetting ink from the recording head 5 mounted on the carriage 1.

Upon reception of a flushing command signal from a flushing controller 42 in addition to the drive signal based on the print data, the head driver 41 also outputs a drive signal for the flushing operation to the recording head 5.

Numeral 43 denotes a cleaning controller. The cleaning controller 43 has a function of receiving a control signal from a cleaning command detector 44 or a cleaning sequence controller 45 and controlling a pump driver 46 for driving the suction pump 29 by the power of the paper feed motor.

From the cleaning sequence controller 45, a control signal is also sent to a carriage motor controller 47, thereby driving the carriage motor 28.

In FIG. 4, numeral 48 denotes a cleaning command switch placed on an operation panel, etc., of the recording apparatus. When the user recognizes a print failure state, for example, he or she operates the cleaning command switch 48, thereby operating the cleaning command detector 44 for executing the cleaning operation.

Next, a recording head cleaning sequence executed by the described ink jet recording apparatus, particularly the capping unit 6 will be discussed according to a flowchart shown in FIG. 5.

The cleaning sequence described below is executed by supplying a control signal from the cleaning sequence controller 45 shown in FIG. 5 to the cleaning controller 43 and the carriage motor controller 47.

First, when cleaning treatment is started, operation unnecessary for the cleaning treatment, such as paper feed operation, is all inhibited at step S11. In this state, the cleaner holder 20 is moved in the horizontal direction and the wiping member 21 is advanced onto the move path of the recording head.

Upon reception of a control signal generated from the cleaning sequence controller 45, the carriage motor controller 47 moves the carriage 1 to the non-print area side.

As the carriage 1 is moved to the non-print area side, the nozzle formation face of the recording head 5 is wiped out by the wiping member 21 as execution of the wiping operation at step S12, whereby dust, paper powder, and the like adhering to the nozzle formation face of the recording head 5 are removed.

Subsequently, the carriage 1 is moved to the capping position and large suction operation of ink from the recording head 5 is executed at step S13. FIGS. 6A to 6D show this state, The parts identical with those previously described with reference to the accompanying drawings are denoted by the same reference numerals in FIGS. 6A to 6D.

Figure 6A:
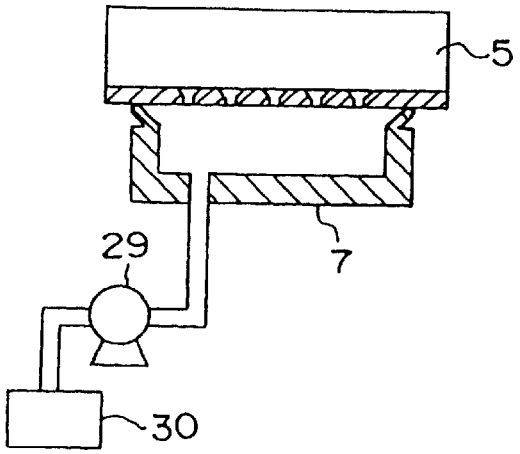
FIGS. 6A to 6D are schematic diagrams to describe the head cleaning operation executed a according to the sequence shown in FIG. 5.
Figure 6B:
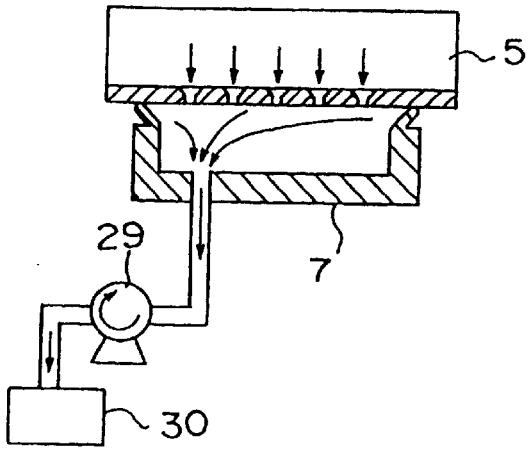

First, FIG. 6A shows a state in which the nozzle formation face of the recording head 5 is sealed by the cap member 7. Subsequently, as shown in FIG. 6B, the suction pump 29 is driven for a predetermined time for accumulating a negative pressure in the cap member 7.

Figure 6C:
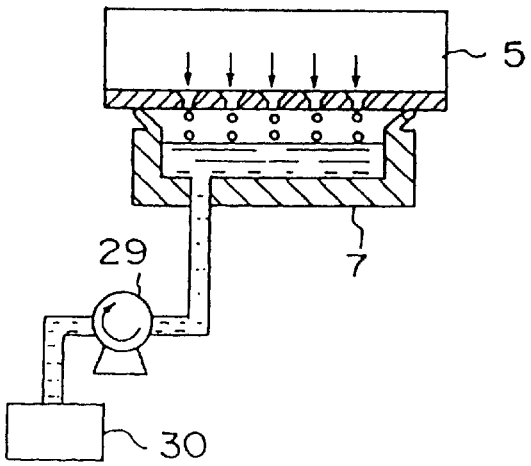
Figure 6D:
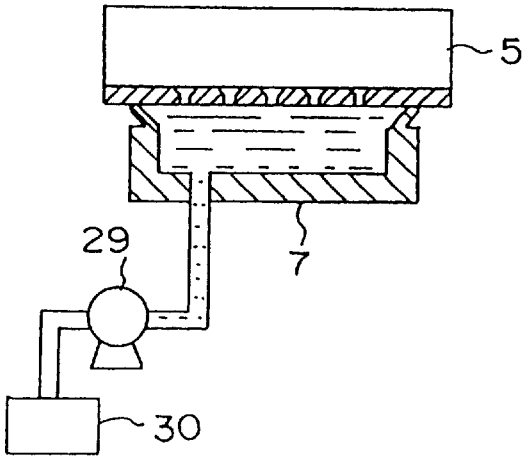

In this state, ink is sucked and discharged into the cap member 7 by the negative pressure accumulated in the inner space of the cap member 7 as shown in FIG. 6C, whereby ink is discharged from the recording head 5 and an amount of ink matching the negative pressure is discharged into the inner space of the cap member 7 as shown in FIG. 6D.

Figure 5:
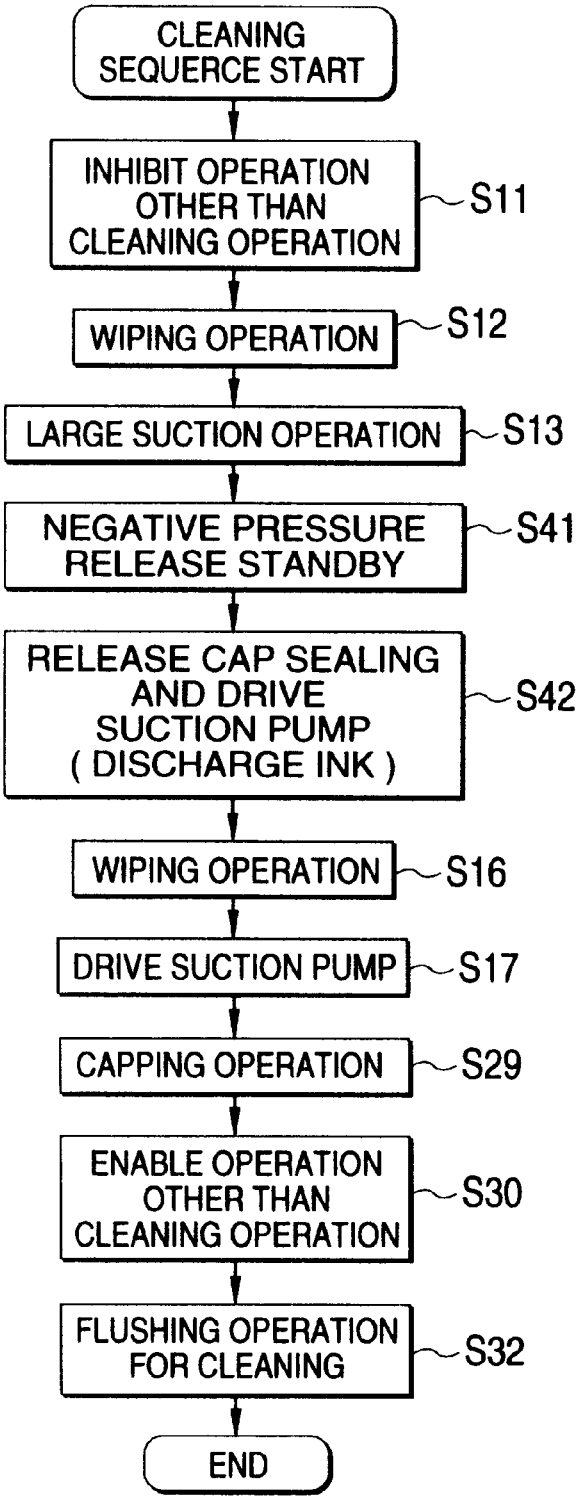
FIG. 5 is a flowchart to show the operation sequence of head cleaning executed in the invention.

Negative pressure release standby processing is executed at step S41 in FIG. 5. That is, at step S41, the state of sealing the nozzle formation face of the recording head 5 by the cap member 7 is held and a wait is made until the expiration of a predetermined time required for the inner space of the cap member 7 to be restored to the atmospheric pressure.

The predetermined time is set to about three seconds, for example. After the expiration of the predetermined time, a predetermined amount of ink is discharged from the recording head 5 and the negative pressure in the inner space of the cap member 7 becomes almost equal to the atmospheric pressure.

Thus, when the pressure in the cap member 7 becomes the atmospheric pressure, control goes to step S42 in FIG. 5 and the nozzle formation face of the recording head 5 sealed by the cap member 7 is unsealed and the suction pump 29 is driven (ink is discharged from the cap member 7).

To unseal the nozzle formation face of the recording head 5 sealed by the cap member 7, the cap member 7 comes off the end part of the print area side and is brought away from the nozzle formation face of the recording head 5 in an inclined state with respect to the nozzle formation face, as described above.

Since the cap member 7 is thus brought away from the nozzle formation face of the recording head 5 in an inclined state, waste ink to remain on the nozzle formation face of the recording head 5 is pulled back to the waste ink stored in the cap member 7, so that the amount of ink left on the nozzle formation face of the recording head 5 can be reduced as much as possible. Since the nozzle formation face of the recording head 5 sealed by the cap member 7 is unsealed from one end part, a phenomenon in which the waste ink stored in the cap member 7 is bubbled unnecessarily can also be lessened.

At the same time as the recording head 5 sealed by the cap member 7 is unsealed, the suction pump 29 is driven for discharging the ink discharged into the cap member 7 into the waste tank 30, as described above.

For example, at the time of replacement cleaning performed after cartridge replacement the ink suction amount is very large and therefore a problem of leaking ink from the cap member 7 is solved.

Subsequently, the wiping operation is executed at step S16 in FIG. 5. In this case, the cleaner holder 20 is already moved in the horizontal direction and the wiping member 21 is advanced to the move path of the recording head 5.

That is, when a transition is made from the ink suction operation to the wiping operation, a time lag is suppressed.

As the carriage 1 is moved, the nozzle formation face of the recording head 5 is wiped out by the wiping member 21 and ink adhering to the nozzle formation face of the recording head 5 is scraped away by the wiping member 21.

In this case, a command is sent from the cleaning sequence controller 45 shown in FIG. 4 to the carriage motor controller 47 for performing speed control of the carriage motor 28.

That is, the carriage motor 28 is controlled so that the drive speed when the placement position of the wiping member 21 advanced onto the move path of the recording head 5 is passed through becomes larger than the drive speed from the sealing state of the nozzle formation face by the capping unit to unsealing. The carriage motor 28 uses a so-called pulse motor undergoing speed control according to the number of pulses.

In the section from the sealing state of the nozzle formation face by the capping unit to unsealing, the cycle of the drive pulse given to the carriage motor 28 is prolonged for relatively slowing down drive of the carriage motor 28.

In the section in which the placement position of the wiping member 21 advanced onto the move path of the recording head 5 is passed through, the cycle of the drive pulse given to the carriage motor 28 is shortened for speeding up drive of the carriage motor 28.

Such control is executed, whereby the operation when the nozzle formation face sealed by the capping unit is unseated can be slowed down; this can contribute to more reduced bubbles of ink in the cap member 7.

Since the carriage move speed is controlled to faster speed at the wiping operation time, the wiping member 21 can rapidly wipe the nozzle formation face of the recording head 5.

Thus, the ink pulling action of the meniscuses formed in the nozzle orifices of the recording head 6 can be decreased and the occurrence frequency of a dot loss caused by bubbles of ink can be lowered.

At step S17 following the wiping operation, the suction pump 29 is again driven.

Figure 7A:
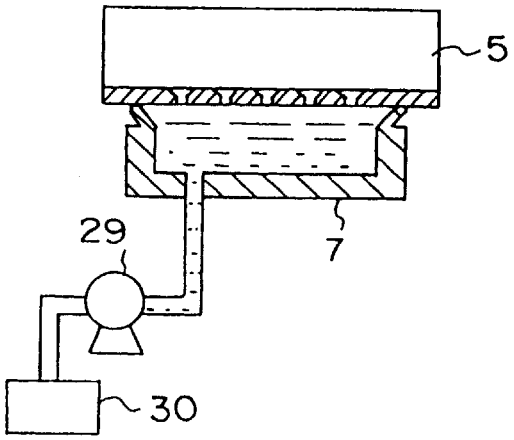
FIGS. 7A to 7C are schematic diagrams to describe the cleaning operation following the operation in FIGS. 6A to 6D.
Figure 7B:
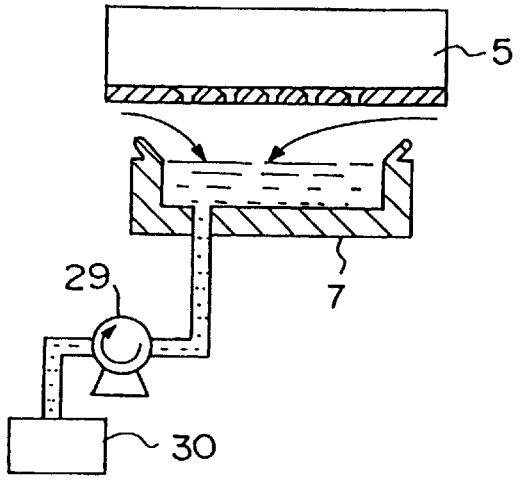
Figure 7C:
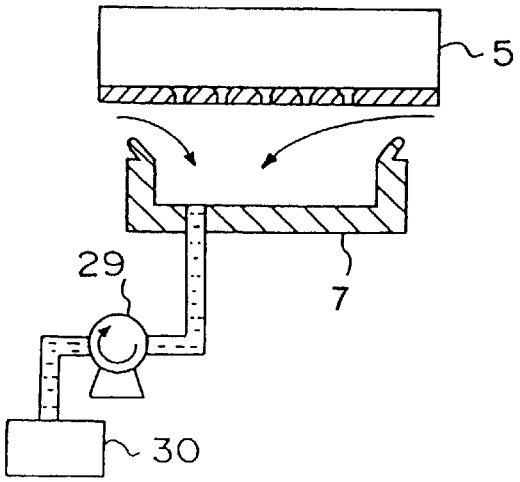

FIGS. 7A to 7C show the operation of the cap member 7 in the state from the wiping operation to the suction pump drive operation.

That is, to make the transition to the wiping state, the carriage 1 is moved to the print area side and from the capping state shown in FIG. 7A, the capping member 7 is moved down as shown in FIG. 7B accordingly, and the capping state is released.

In this state, ink discharged from the recording head 5 and left at step S42 remains in the cap member 7.

The suction pump 29 is driven at step S17, whereby the ink remaining in the cap member 7 is sucked to the suction pump 29 and is discharged into the waste tank 30, as shown in FIG. 7C.

The steps are executed, whereby the factor of producing bubbles in ink in the cap member 7 can be eliminated as much as possible and therefore the evil effect produced by bubbles of ink as the atmosphere valve is opened as in the recording apparatus comprising the atmosphere valve in the related art can be removed.

Figure 13:
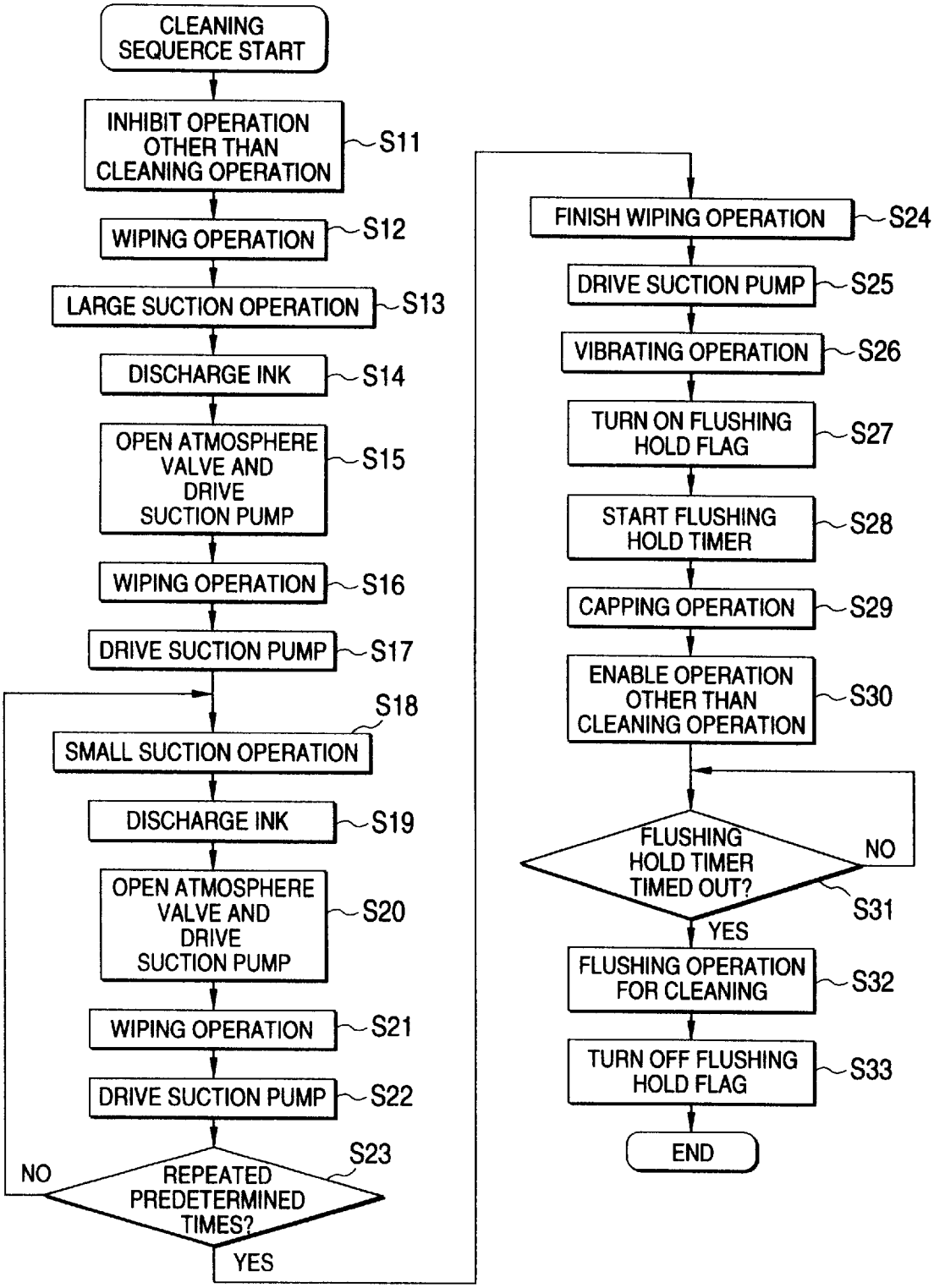
FIG. 13 is a flowchart to show the operation sequence of head cleaning executed by the related recording apparatus shown in FIG. 12.
Figure 14A:
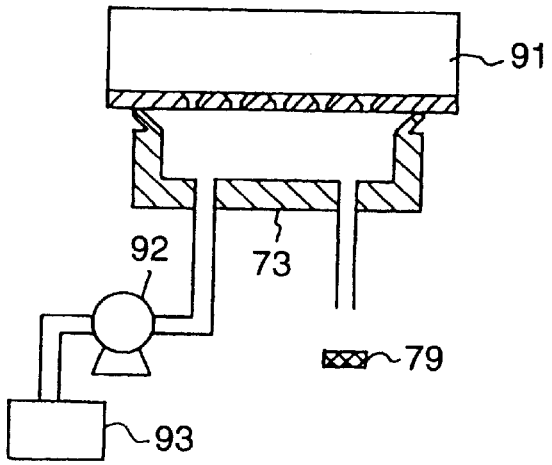
FIGS. 14A to 14D are schematic diagrams to describe the head cleaning operation executed according to the related sequence shown in FIG. 13.
Figure 14B:
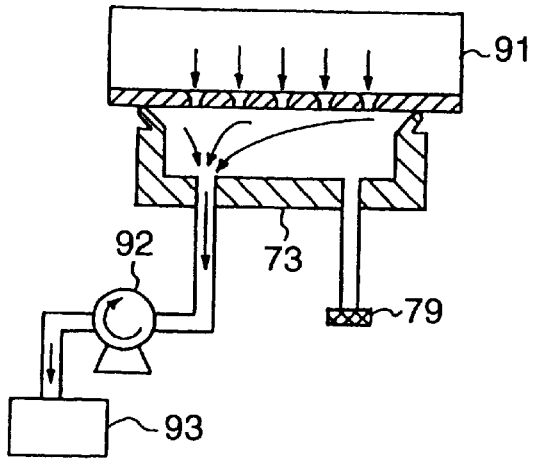
Figure 14C:
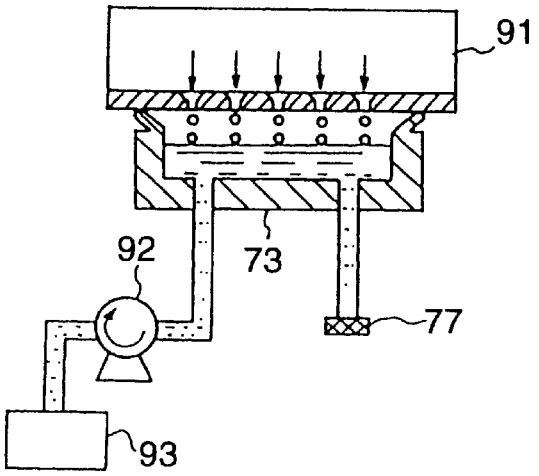
Figure 14D:
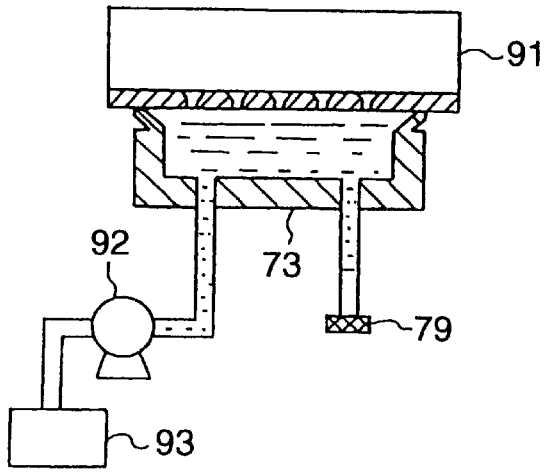
Figure 15A:
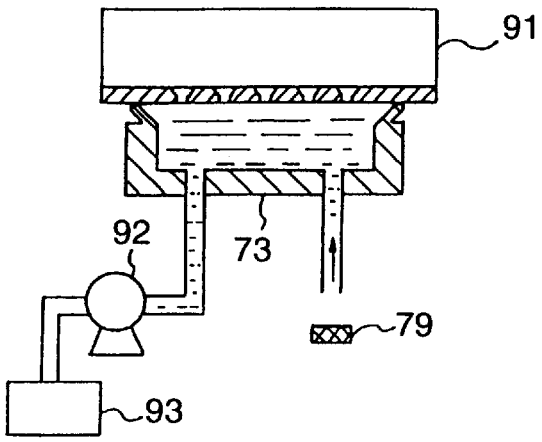
FIGS. 15A to 15C are schematic diagrams to describe the cleaning operation following the operation in FIGS. 14A to 14D.
Figure 15B:
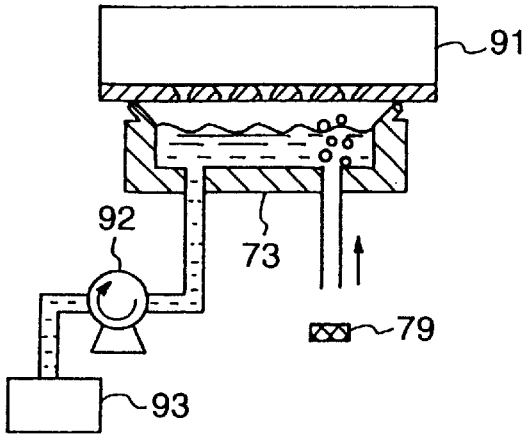
Figure 15C:
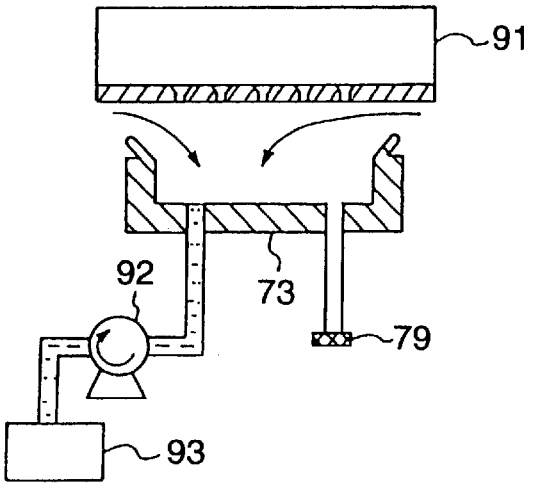

In other words, the problem of destroying the meniscuses formed in the nozzle orifices of the recording head because of bubbles of ink can be circumvented. Therefore, the operation of restoring the meniscuses to their former shapes by repeating the loop of steps S18 to S22 shown in FIG. 13 more than once becomes unnecessary. Further, the appurtenant control steps like steps S24 to S28 shown in FIG. 13 can also skipped.

Therefore, control can go to step S29, namely, the capping operation directly from step S17 shown in FIG. 5; at step S29, the recording head 5 is moved to the capping position and the nozzle formation face of the recording head 5 is sealed by the cap member 7.

Subsequently, any inhibited operation other than the cleaning treatment is enabled at step S30 and the flushing operation for cleaning is executed at step S32. In this state, a standby mode is entered and the cleaning operation is complete.

As seen from the description made so far, according to the ink jet recording apparatus and the cleaning control method in the recording apparatus according to the invention, an atmosphere valve for opening the inner space of the cap member to the atmosphere can be eliminated and therefore managing and assembling the assembly parts making up the atmosphere valve can be skipped.

Thus, it is made possible to reduce costs and enhance yield. Occurrence of bubbles in the cap member because of use of an atmosphere valve can also be circumvented and the problem of destroying the meniscuses formed in the nozzle orifices because of occurrence of bubbles can also be solved. Therefore, it is also made possible to skip the cleaning step for restoring the destroyed meniscuses to their former shapes and the time required for the cleaning operation can also be shortened.

On the other hand, in the configuration wherein an atmosphere valve is eliminated from the capping unit, the operation of releasing the capping state occurs in the state in which waste ink is stored in the cap member 7 as previously described with reference to FIGS. 7A and 7B. If vibration, etc., is received in such a state, ink is leaked from the inside of the capping unit to the outside and particularly waste ink is deposited and remains on the outer peripheral surface of the cap member forming the sealing part of the capping unit; this is a problem, A problem of secondarily contaminating recording paper, the drive mechanism of the recording apparatus, and the like by the remaining waste ink can occur.

Then, FIGS. 8 to 11 show a recording apparatus according to a second embodiment of the invention to circumvent such a problem. That is, in the following configuration, ink to remain on the outer peripheral surface of a cap member is aggressively escaped in the gravity direction and the amount of ink adhering to a recording head can be decreased for circumventing contamination of recording paper, etc.

Figure 8:
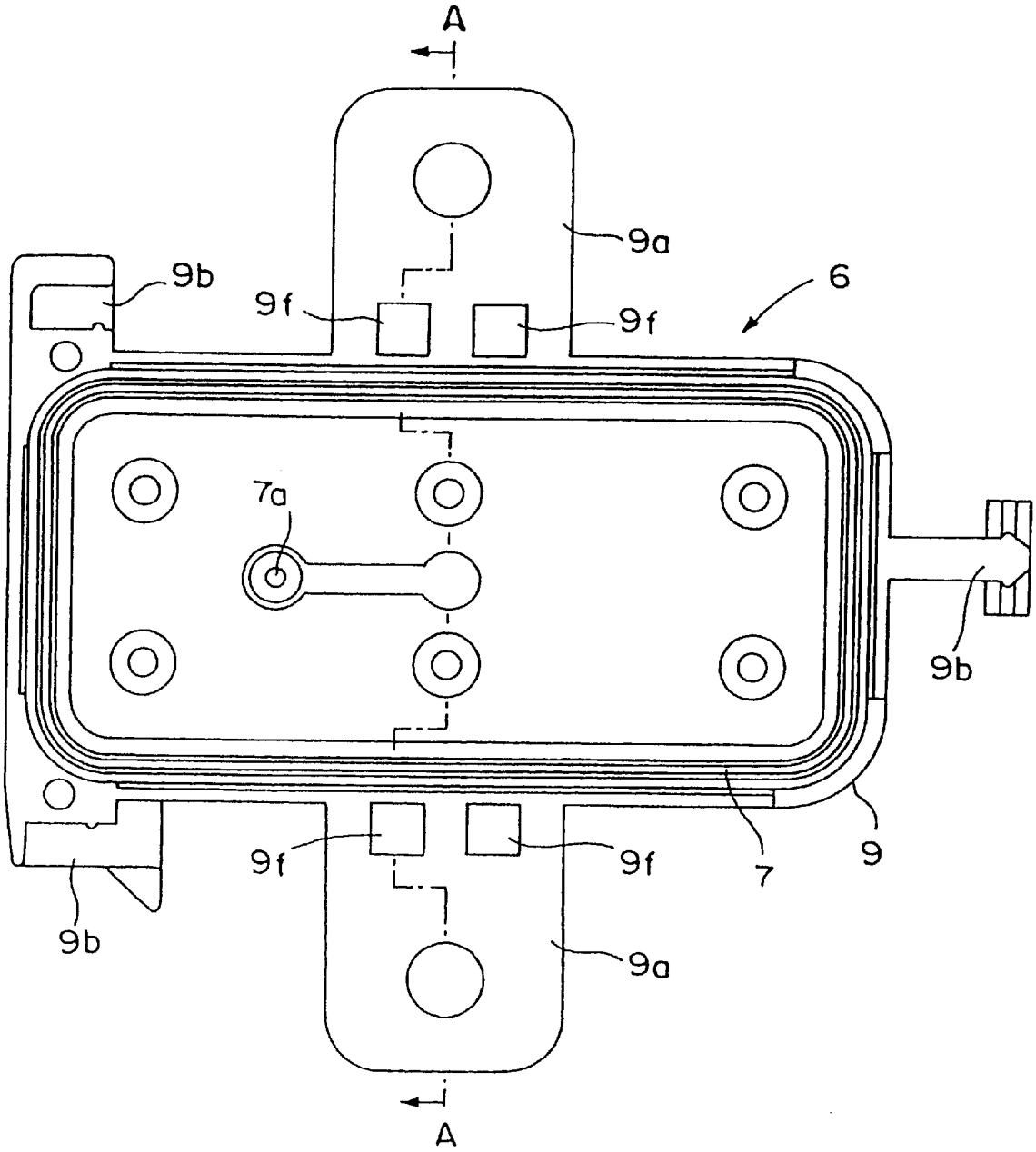
FIG. 8 is a plan view to show the configuration of a cap holder and a cap member constituting a capping unit in an ink jet recording apparatus according to a second embodiment of the invention.
Figure 9:
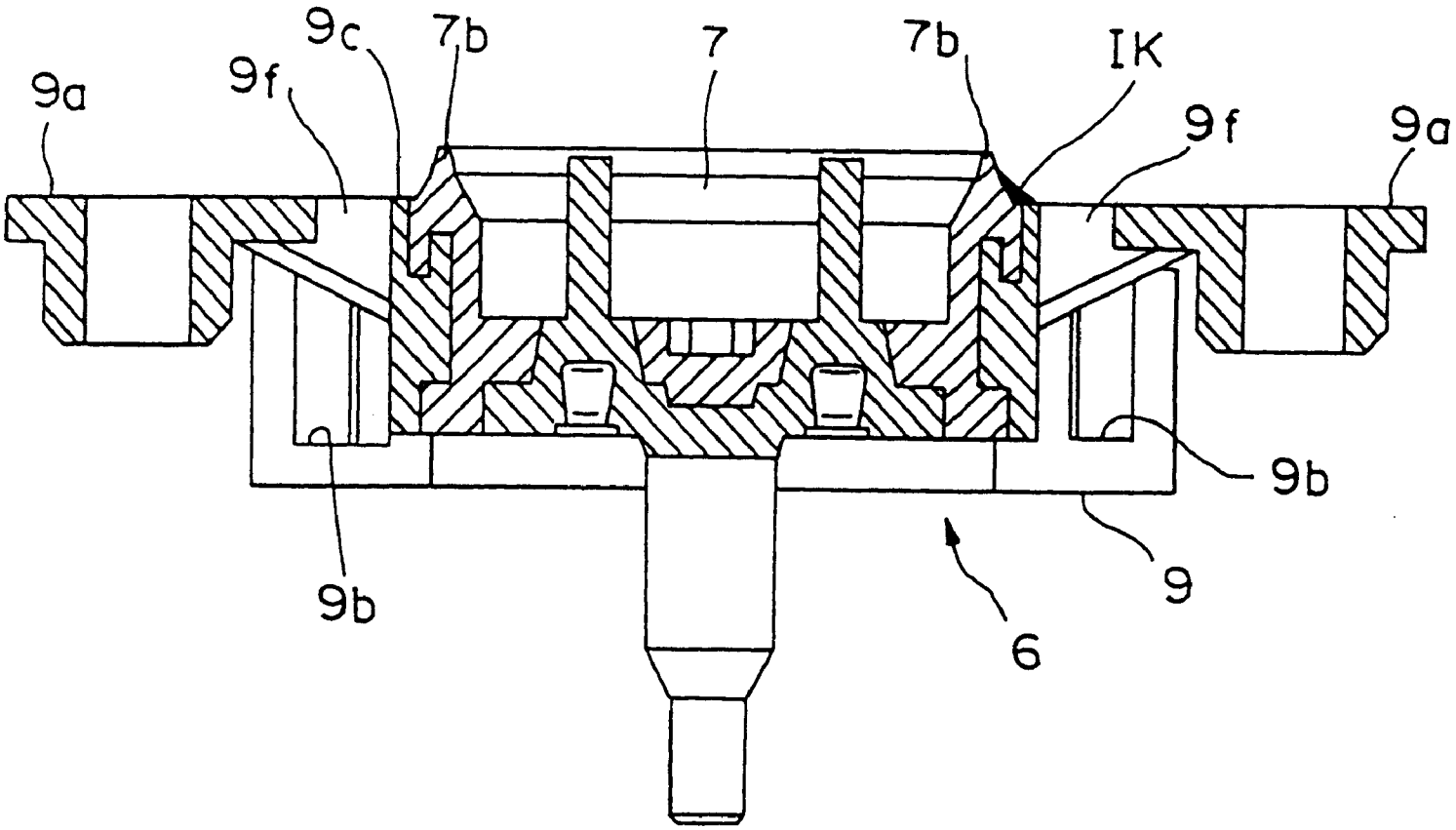
FIG. 9 is a sectional view of the capping unit taken on line A—A in the arrow direction in FIG. 8.

First, FIGS. 8 and 9 show the configuration of a cap holder and a cam member making up a capping unit. FIG. 8 is a plan view of an assembly of the cap holder and the cap member from the top and FIG. 9 is a sectional view taken on line A—A in the arrow direction in FIG. 8. Parts identical with those previously described with reference to FIGS. 1 to 3 are denoted by the same reference numerals in FIGS. 8 and 9.

A cap member 7 is integrally molded, for example, by insert molding or two-color molding in the inside of a cap holder 9 formed like a rectangle. The cap holder 9 is made of a hard synthetic resin, for example, and the cap member 7 is made of a soft material, for example, an elastomer or rubber.

To integrally mold the cap member 7 and the cap holder 9 by insert molding, first the cap holder 9 is molded in a predetermined mold, the cap holder 9 thus molded is placed in a second mold, and a soft material to form the cap member 7 is insert-molded, whereby the cap member 7 and the cap holder 9 are molded integrally.

To integrally mold the cap member 7 and the cap holder 9 by two-color molding, first the cap holder 9 is primarily molded in a predetermined mold and the space formed by the cap holder 9 of the primarily molded article and a secondary mold cavity is filled with a soft material to form the cap member 7, whereby the cap member 7 and the cap holder 9 are molded integrally.

As shown in FIG. 9, on the inner face of the cap holder 9 primarily molded, the cap member 7 secondarily molded is formed projecting toward an opening end face 9*c* of the cap holder 9.

Figure 10:
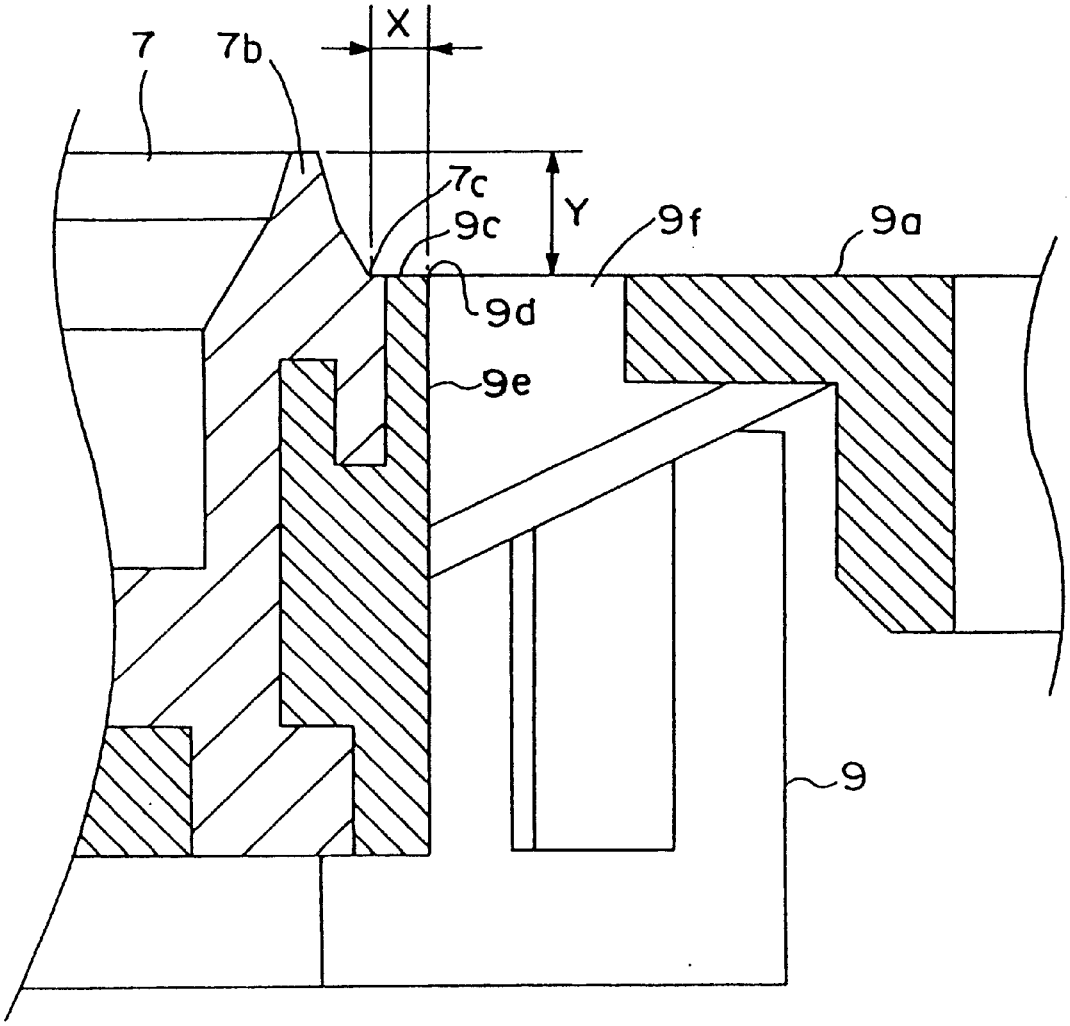
FIG. 10 is a sectional view, on an enlarged scale, of the main part of the capping unit shown in FIG. 9.

As the main part is shown in FIG. 10 on an enlarged scale, a projected part 7*b* of the cap member 7 is almost triangular in cross section and the end face of the top forms a sealing part to abut the nozzle formation face of a recording head.

According to the structure, the intimate contact degree of the sealing part to abut the nozzle formation face of the recording head can be increased for keeping a good hermetic state of the inner space of the capping unit Further, the dimension relationship between projection height Y of the cap member 7 from the opening end face 9*c* of the cap holder 9 and horizontal width X from a rising part 7*c* of the cap member 7 touching the opening end face 9*c* of the cap holder 9 to an opening margin 9*d* of the cap holder 9 positioned on the outer peripheral surface is $X<Y$.

Thus, as shown in FIG. 9, ink IK to remain on the rise outer peripheral wall of the cap member 7 flows beyond the opening margin 9*d* of the cap holder 9 and drops along a side wall part 9*e* of the cap holder 9 by gravitation and therefore the amount of the ink IK remaining on the rise outer peripheral wall of the cap member 7 can be decreased as much as possible.

Thus, it is made possible to effectively circumvent the problem of allowing the ink IK remaining on the rise outer peripheral wall of the cap member 7 to adhere to t recording head and drip down on recording paper for secondarily contaminating the recording paper, etc.

A flat spring holder 9*a* is formed in a horizontal direction on a side wall part of the cap holder 9 in the length direction thereof. In the embodiment, the top face of the spring holder 9*a* is formed almost flush with the opening end face 9*c* of the cap holder 9 and the spring holder 9*a* is formed with openings 9*f* for escaping ink remaining on the outer peripheral surface of the cap member 7 in the gravity direction.

Figure 11:
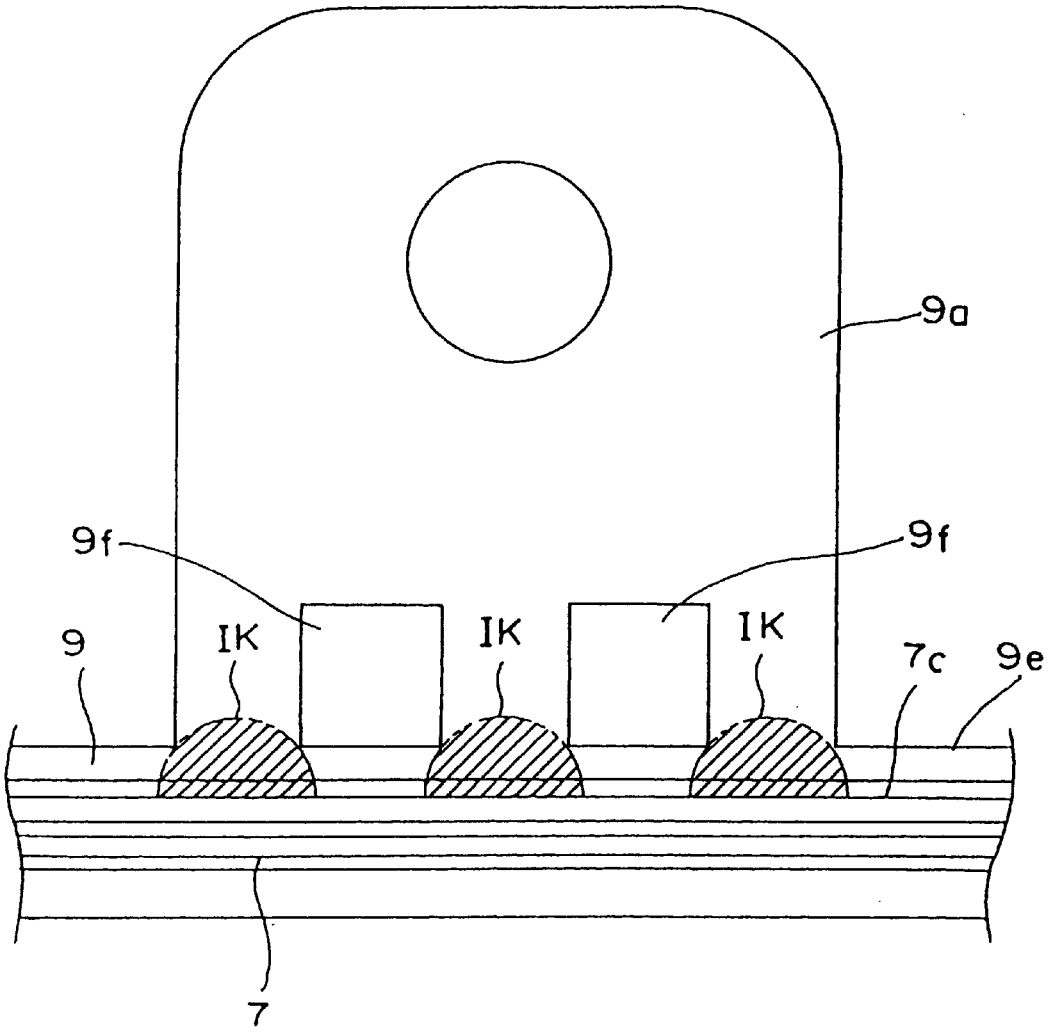
FIG. 11 is a plan view, on an enlarged scale, of the main part of the capping unit shown in FIG. 8.
Figure 12:
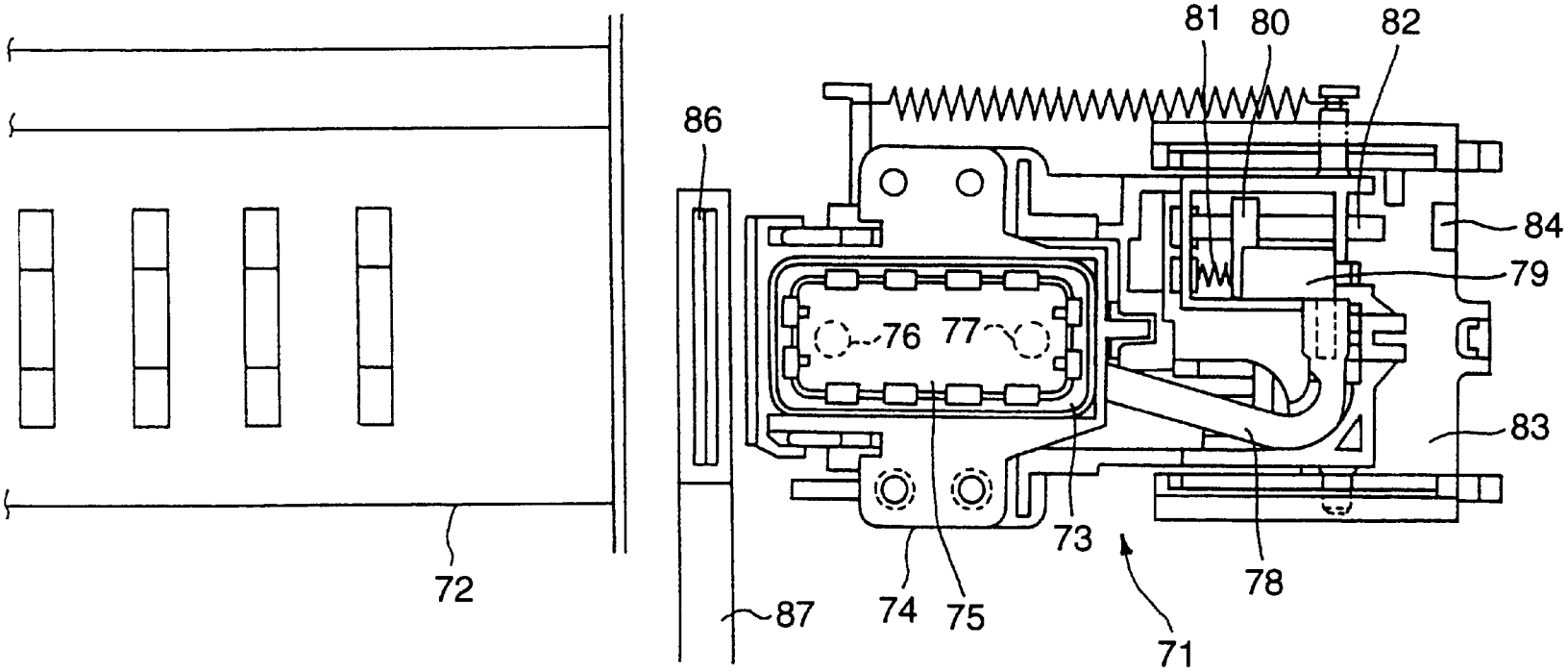
FIG. 12 is a plan view to mainly show the configuration of a capping unit in a related recording apparatus.

As the main part is shown in FIG. 11 on an enlarged scale, two adjacent openings 9*f* are placed along the side wall part 9*e* of the cap holder 9.

According to the structure, the area of ink IK to remain on the top face of the spring holder 9*a* becomes slight although an ink pool occurs at the position indicated as IK formed in the relationship between the distance between the two openings 9*f* and the distance between each opening 9*f* and the rising part 7*c* of the cap member 7 between the two adjacent openings 9*f*, for example, as schematically shown in FIG. 11.

Likewise, the area becomes slight although an ink pool occurs at the position indicated as IK formed in the relationship between the distance between an end part of the spring holder 9*a* in the extension direction thereof and the opening 9*f* and the distance between the opening 9*f* and the rising part 7*c* of the cap member 7.

Consequently, ink to remain on the top face of the flat spring holder 9*a* can be effectively discharged through the openings 9*f*, contributing to the ink amount reducing effect on the top face of the spring holder where ink easily remains.

In this case, preferably the opening 9*f* is shaped like a polygon forming corners on the inner faces of the opening; in the example shown in the figure, the opening 9*f* is shaped like a square. That is, if ink comes at the corner where the inner faces of the opening shaped like a square are orthogonal to each other, it is collected at the comer by capillary action, and the collected ink is guided to the back side of the spring holder 9*a* by gravitation.

Therefore, even in the structure wherein the flat spring holder 9*a* is formed, the amount of ink to remain on the top face of the spring holder 9*a* can be decreased drastically, and it is made possible to circumvent the problem of allowing the remaining ink to adhere to the recording head and contaminate recording paper.

In the embodiment shown in FIG. 11, the spring holder 9*a* is formed with the two openings 9*f*; the number of the openings 9*f* can be selected appropriately in response to the width formed in the length direction of the spring holder 9*a*. The shape of the opening 9*f* is not limited to the square and any other polygon can be selected.

As seen in the description made so far, according to the ink jet recording apparatus according to the second embodiment of the invention, the cap member is formed projecting toward the opening end face of the cap holder and the projection height is made larger than the horizontal width from the rising part of the cap member touching the opening end face of the cap holder to the opening margin of the cap holder positioned on the outer peripheral surface, so that ink to remain on the outer peripheral surface of the cap member can be effectively escaped in the gravity direction.

Therefore, the amount of ink to remain on the outer peripheral surface of the cap member can always be decreased and it is made possible to minimize the problem of allowing the remaining ink to adhere to the recording head and contaminate recording paper, etc.

In addition, in the structure wherein the spring holder is formed on the side wall part of the cap holder, the openings are placed close to the cap member with respect to the spring holder, whereby ink can be escaped in the gravity direction through the openings. Thus, the amount of ink to remain on the top face of the spring holder can be decreased effectively.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. An ink jet recording apparatus comprising:

a recording head having a face on which nozzle orifices from which ink drops are ejected in accordance with print data are formed;

a carriage for mounting the recording head;

a capping unit having a sealing face for sealing the nozzle formation face of the recording head, and having an inner space connected to a suction pump only;

a wiping member for wiping the nozzle formation face; and a controller for controlling the capping unit so as to (i) seal the nozzle formation face with the sealing face, (ii) drive the suction pump to apply negative pressure into the inner space to discharge ink from the nozzle orifices, and (iii) keep the sealing state until a first predetermined time period required for restoring the negative pressure to the atmospheric pressure elapses after the ink has been discharged.

2. The ink jet recording apparatus as set forth in claim 1, wherein the wiping member moves from an initial position to a second position where is on a moving path of the recording head when the capping unit executes the ink discharge operation.

3. The ink jet recording apparatus as set forth in claim 1, wherein the controller separates the capping unit from the nozzle formation face such that the sealing face is inclined with respect to the nozzle formation face after the first predetermined time period has elapsed.

4. The ink jet recording apparatus as set forth in claim 1, further comprising a waste ink tank connected to the capping unit via the suction pump, wherein the controller drives the suction pump to discharge ink stored in the inner space into the waste ink tank when the capping unit is separated from the nozzle formation face.

5. The ink jet recording apparatus as set forth in claim 1, wherein the controller controls the wiping member so as to wipe the nozzle formation face after the capping unit has been separated from the nozzle formation face.

6. An ink jet recording apparatus comprising:

a recording head having a face on which nozzle orifices from which ink drops are ejected in accordance with print data are formed;

a carriage for mounting the recording head;

a capping unit having a sealing face for sealing the nozzle formation face of the recording head, and having an inner space connected to a suction pump;

a wiping member for wiping the nozzle formation face; and a controller for controlling the capping unit so as to (i) seal the nozzle formation face with the sealing face (ii) drive the suction pump to apply negative pressure into the inner space to discharge ink from the nozzle orifices, and (iii) keep the sealing state until a first predetermined time period required for restoring the negative pressure to the atmospheric pressure elapses after the ink has been discharged, wherein the wiping member moves from an initial position to a second position where is on a moving path of the recording head when the capping unit executes the ink discharge operation;

wherein the capping unit is moved toward the recording head to seal the nozzle formation face by using driving force of the carriage motor for moving the carriage toward the home position;

wherein the capping unit is separated from the nozzle formation face by using driving force of the carriage motor for moving the carriage toward the print region; and wherein the carriage motor has a first speed established when the capping unit is separated from the recording head and a second speed, which is faster than the first speed, established when the carriage passes through the second position of the wiping member.

7. The ink jet recording apparatus as set forth in claim 5, wherein the controller drives the suction pump again after the nozzle formation face has been wiped out by the wiping member in order to discharge ink stored in the inner space of the capping unit.

8. The ink jet recording apparatus as set forth in claim 6, wherein the controller drives the suction pump again after the nozzle formation face has been wiped out by the wiping member in order to discharge ink stored in the inner space of the capping unit.

9. An ink jet recording apparatus comprising:

a recording head having a face on which nozzle orifices from which ink drops are ejected in accordance with print data are formed;

a carriage for mounting the recording head;

a capping unit having a sealing face for sealing the nozzle formation face of the recording head, and having an inner space connected to a suction pump;

a wiping member for wiping the nozzle formation face: and a controller for controlling the capping unit so as to (i) seal the nozzle formation face with the sealing face (ii) drive the suction pump to apply negative pressure into the inner space to discharge ink from the nozzle orifices, and (iii) keep the sealing state until a first predetermined time period required for restoring the negative pressure to the atmospheric pressure elapses after the ink has been discharged, wherein the capping unit includes a cap member made of a flexible material, which is to be abutted against and seal the nozzle formation face, and a cap holder made of a hard material and having a circumferential wall for holding the cap member therein;

wherein the cap member has a portion protruded from an upper end face of the circumferential wall; and wherein a dimension between a top end of the protruded portion and the upper end face of the circumferential wall is larger than a dimension between a lower end of the protruded portion and an outer edge of the circumferential wall.

10. The ink jet recording apparatus as set forth in claim 9, wherein the protruded portion of the cap member has a cross section shaped into a substantially triangle.

11. The ink jet recording apparatus as set forth in claim 9, wherein the capping unit includes a spring for urging the cap member toward the nozzle formation face;

wherein the cap holder includes a spring holder formed on a outer face of the circumferential wall of the cap holder for holding one end of the spring; and wherein the spring holder has at least one opening for leading ink remaining on an outer circumferential face of the cap member toward a gravity direction.

12. The ink jet recording apparatus as set forth in claim 11, wherein a plurality of openings are adjacently arranged along the outer face of the circumferential wall of the cap holder.

13. The ink jet recording apparatus as set forth in claim 11, wherein the opening is shaped into a polygon forming corners therein.

14. The ink jet recording apparatus as set forth in claim 11, wherein an upper face of the spring holder and the upper end face of the circumferential define a substantially identical plane.

15. The ink jet recording apparatus as set forth in claim 9, wherein the cap member and the cap holder are integrally formed by either an insert molding or a two-color molding.

16. The ink-jet recording apparatus as set forth in claim 9, wherein the flexible material is either an elastomer or rubber.

17. A cleaning control method for an ink jet recording apparatus which comprises: a recording head having a face on which nozzle orifices from which ink drops are ejected in accordance with print data are formed; a carriage for mounting the recording head; a capping unit having a sealing face for seating the nozzle formation face of the recording head, and having an inner space connected to a suction pump; and a wiping member for wiping the nozzle formation face, the method comprising the steps of:

sealing the nozzle formation face with the capping unit;

driving the suction pump to apply negative pressure into the inner space to discharge ink from the nozzle orifices;

waiting until a first predetermined time period required for restoring the negative pressure to the atmospheric pressure elapses without driving the suction pump while keeping a state that the nozzle formation face is sealed with the capping unit; and separating the capping unit from the nozzle formation face after the first predetermined time period has elapsed.

18. The cleaning control method as set forth in claim 17, further comprising the step of driving the suction pump to discharge ink stored in the inner space of the capping unit into an ink waste tank synchronously with the separating step.

19. The cleaning control method as set forth in claim 17, further comprising the step of wiping the nozzle formation face with the wiping member.

20. The cleaning control method as set forth in claim 18, further comprising the step of wiping the nozzle formation face with the wiping member executed after the separating step has been executed.

21. The cleaning control method as set forth in claim 19, further comprising the step of driving the suction pump again to discharge ink stored in the inner space of the capping unit after the wiping step has been executed.

22. The cleaning control method as set forth in claim 20, further comprising the step of driving the suction pump again to discharge ink stored in the inner space of the capping unit after the wiping step has been executed.

* * * * *